US008986466B2

(12) United States Patent
Abe et al.

(10) Patent No.: US 8,986,466 B2
(45) Date of Patent: Mar. 24, 2015

(54) METHOD FOR CARBURIZING TANTALUM MEMBER, AND TANTALUM MEMBER

(75) Inventors: Yoshihisa Abe, Osaka (JP); Masanari Watanabe, Osaka (JP); Osamu Tamura, Osaka (JP)

(73) Assignee: Toyo Tanso Co., Ltd., Osaka (JP)

( * ) Notice: Subject to any disclaimer, the term of this patent is extended or adjusted under 35 U.S.C. 154(b) by 501 days.

(21) Appl. No.: 13/322,936

(22) PCT Filed: May 25, 2010

(86) PCT No.: PCT/JP2010/058799

§ 371 (c)(1),
(2), (4) Date: Nov. 29, 2011

(87) PCT Pub. No.: WO2010/140508

PCT Pub. Date: Dec. 9, 2010

(65) Prior Publication Data

US 2012/0067462 A1 Mar. 22, 2012

(30) Foreign Application Priority Data

Jun. 1, 2009 (JP) ..... 2009-132051
Jun. 4, 2009 (JP) ..... 2009-134949

(51) Int. Cl.
*C23C 8/22* (2006.01)
*C21D 9/00* (2006.01)
*C23C 8/64* (2006.01)

(52) U.S. Cl.
CPC ..... *C23C 8/64* (2013.01)
USPC ..... 148/223; 148/316; 266/249

(58) Field of Classification Search
USPC ..... 148/223, 316; 266/249
See application file for complete search history.

(56) References Cited

U.S. PATENT DOCUMENTS

| | | | | |
|---|---|---|---|---|
| 3,466,494 | A * | 9/1969 | Eichin et al. | 315/3.5 |
| 2004/0250921 | A1* | 12/2004 | Yamaguchi | 148/218 |
| 2005/0205164 | A1* | 9/2005 | Tachisato | 148/225 |
| 2007/0059501 | A1* | 3/2007 | Kaneko et al. | 428/209 |
| 2008/0073001 | A1* | 3/2008 | Katsumata | 148/223 |

FOREIGN PATENT DOCUMENTS

| | | |
|---|---|---|
| EP | 1 666 413 A1 | 6/2006 |
| JP | 05-044339 U | 6/1993 |

(Continued)

OTHER PUBLICATIONS

Official Communication issued in International Patent Application No. PCT/JP2010/058799, mailed on Aug. 10, 2010.

*Primary Examiner* — Roy King
*Assistant Examiner* — Jenny Wu
(74) *Attorney, Agent, or Firm* — Keating & Bennett, LLP

(57) ABSTRACT

Provided is a method for carburizing a tantalum member whereby the tantalum member is less deformed by carburization and can be carburized with good flatness of the planar part thereof and in a uniform manner. The method is a method for subjecting a tantalum member 1 made of tantalum or a tantalum alloy and having a planar part 1*a* to a carburization process for allowing carbon to penetrate the member 1 from the surface toward the inner portion thereof and includes the steps of: setting the tantalum member 1 in a chamber 3 containing a carbon source by supporting the planar part 1*a* on a plurality of support rods 6 tapered at distal ends 6*a* thereof; and subjecting the tantalum member 1 to a carburization process by reducing in pressure and heating the interior of the chamber 3 to allow carbon derived from the carbon source to penetrate the tantalum member 1 from the surface thereof.

7 Claims, 15 Drawing Sheets

(56) References Cited

FOREIGN PATENT DOCUMENTS

| | | | |
|---|---|---|---|
| JP | 2000-286330 | A | 10/2000 |
| JP | 2002-161314 | A | 6/2002 |
| JP | 2005-068002 | A | 3/2005 |
| JP | 2008-016691 | A | 1/2008 |
| JP | 2008-081362 | A | 4/2008 |
| JP | 2009-242854 | A | 10/2009 |

* cited by examiner

METHOD FOR CARBURIZING TANTALUM MEMBER, AND TANTALUM MEMBER

TECHNICAL FIELD

This invention relates to methods for subjecting a member made of tantalum or a tantalum alloy, such as a tantalum container or a tantalum lid, to a carburization process for allowing carbon to penetrate the member from its surface toward its inner portion, and to tantalum members obtained by the methods.

BACKGROUND ART

Silicon carbide (SiC) is considered as capable of achieving high-temperature performance, high-frequency performance, voltage resistance, and environment resistance each of which could not be achieved by conventional semiconductor materials, such as silicon (Si) and barium arsenide (BaAs), and is therefore expected as a semiconductor material for next-generation power devices and high-frequency devices.

Patent Literature 1 proposes to use a tantalum container having a tantalum carbide layer formed on the surface thereof as a chamber in thermally annealing the surface of a single crystal silicon carbide substrate and in growing a single crystal of silicon carbide on a single crystal silicon carbide substrate. The literature reports that by containing a single crystal silicon carbide substrate in a tantalum container having a tantalum carbide layer on the surface thereof and thermally annealing its surface or growing a silicon carbide single crystal on its surface, a single crystal silicon carbide substrate or a silicon carbide single crystal layer can be formed in which its surface is planarized and has less defects.

Patent Literatures 2 and 3 propose that in allowing carbon to penetrate the surface of tantalum or a tantalum alloy to form tantalum carbide on the surface, $Ta_2O_5$ as a naturally oxidized film on the surface is removed by sublimation and carbon is then allowed to penetrate the surface.

However, no specific method for carburizing a tantalum container and a tantalum lid has been discussed in the literatures.

CITATION LIST

Patent Literature

Patent Literature 1: JP-A-2008-16691
Patent Literature 2: JP-A-2005-68002
Patent Literature 3: JP-A-2008-81362

SUMMARY OF INVENTION

Technical Problem

A first object of the present invention is to provide a method for carburizing a tantalum member whereby the tantalum member is less deformed by the carburization and can be carburized with good flatness of the planar part thereof and in a uniform manner, a tantalum member obtained by the method, and a carburizing jig for use in the method.

A second object of the present invention is to provide a method for carburizing a tantalum container whereby in carburizing a tantalum container with an opening, the opening can be prevented from being enlarged by the carburization, and a tantalum container carburized in accordance with the method.

Solution to Problem

A carburizing method according to a first aspect of the present invention is a method for subjecting a tantalum member made of tantalum or a tantalum alloy and having a planar part to a carburization process for allowing carbon to penetrate the member from the surface toward the inner portion thereof and includes the steps of: setting the tantalum member in a chamber containing a carbon source by supporting the planar part on a plurality of support rods tapered at distal ends thereof; and subjecting the tantalum member to a carburization process by reducing in pressure and heating the interior of the chamber to allow carbon derived from the carbon source to penetrate the tantalum member from the surface thereof.

In the first aspect of the present invention, a carburization process is performed with the planar part supported on the plurality of support rods tapered at their distal ends. Since the distal ends of the support rods are tapered, the area in which the distal ends of the support rods are to be in contact with the planar part can be made small. Otherwise the portions of the planar part in contact with the support rods might be less likely to be carburized with carbon derived from the carbon source, or might stick to the support rods if the support rods are carbon sources as described later. In the first aspect of the present invention, since the distal ends of the support rods are tapered, the contact area can be made small, providing a uniform carburization.

In addition, in the first aspect of the present invention, since the planar part is supported on the plurality of support rods, the deformation of the tantalum member due to carburization can be reduced and the tantalum member can be carburized while maintaining good flatness of the planar part.

In the first aspect of the present invention, the plurality of support rods are preferably distributed so that the distal ends of the support rods substantially evenly support the entire planar part. Thus, the deformation due to carburization can be further reduced and the flatness of the planar part can be made better.

In the first aspect of the present invention, it is preferred that the plurality of support rods be distributed and the planar part be supported by the support rods, one or more per 1500 $mm^2$ of the area of the planar part. Thus, the deformation due to carburization can be further reduced and the flatness of the planar part can be made better.

In the first aspect of the present invention, the support rods preferably serve as the carbon source. With the support rods serving as the carbon source, the carbon source can be located near the tantalum member, so that a sufficient amount of carbon can be supplied to the surface of the tantalum member to provide a more uniform carburization.

Furthermore, in the first aspect of the present invention, the distal ends of the support rods are tapered so that their diameter diminishes toward the extremity. Therefore, the area of the distal end of each support rod to be in contact with the planar part of the tantalum member can be made small. With the support rods serving as the carbon source, if the area thereof in contact with the planar part of the tantalum member is large, the planar part of the tantalum member may stick to the distal ends of the support rods, so that the distal ends of the support rods may not be able to be detached from the planar part of the tantalum member after the carburization process. In addition, the carbon concentration at the region of the planar part in contact with the distal ends of the support rods may be high, so that a uniform carburization may not be able to be achieved.

In the first aspect of the present invention, the chamber preferably serves as the carbon source. Since the chamber encloses the tantalum member, the chamber serving as the carbon source enables the entire surface of the tantalum member to be uniformly carburized.

When the support rods and/or the chamber serve as the carbon source, an example of a usable material for the carbon source is graphite. Because the chamber and the support rods will be thermally treated at high temperatures, the preferred graphite for use is an isotropic graphite material. More preferred is a high-purity graphite material subjected to high purity treatment using a halogen-containing gas or the like. The ash content in the graphite material is preferably 20 ppm or less, more preferably 5 ppm or less. Its bulk density is preferably 1.6 or more, more preferably 1.8 or more. The upper limit of the bulk density is 2.1, for example. An example of a method for producing an isotropic graphite material is as follows. Petroleum coke or coal coke serving as a filler is ground to particles of a few micrometers to tens of micrometers in diameter, a binder, such as pitch, coal tar, or coal tar pitch, is added to the filler, followed by kneading of them. The resultant kneaded product is ground to particles of a few micrometers to tens of micrometers in diameter to have a greater ground particle size than the filler as a base material, thereby obtaining a ground product. It is preferred that particles of over 100 μm in diameter should be removed. The ground product is formed, fired, and graphitized to produce a graphite material. Thereafter, the graphite material is subjected to high purity treatment using halogen-containing gas or the like to give an ash content of 20 ppm or less in the graphite material, so that the mixture of impurity elements from the graphite material into the tantalum member can be prevented.

In the first aspect of the present invention, preferably, the plurality of support rods are arrayed on a support base in such a manner that the root portions of the support rods are supported to the support base, and the plurality of support rods are arranged in the chamber in such a manner that the support base is put on the bottom of the interior of the chamber. In this case, the support base may serve as the carbon source. The preferred material for use as the carbon source is graphite, such as an isotropic graphite material, like the above.

The tantalum member in the first aspect of the present invention is preferably a tantalum container having the planar part and a sidewall part extending substantially vertically from the planar part and also having an opening defined by an end of the sidewall part. In carburizing the tantalum container by the carburizing method according to the first aspect of the present invention, it is preferred that the tantalum container be set in the chamber to face the opening of the tantalum container downward and the planar part of the tantalum container be supported from the inside on the plurality of support rods.

A tantalum member according to the first aspect of the present invention is characterized by being carburized by the method according to the first aspect of the present invention.

A carburizing jig according to the first aspect of the present invention is a jig for use in the carburizing method according to the first aspect of the present invention and includes the plurality of support rods and the support base, wherein the support rods and the support base are formed from a graphite material. The preferred graphite material for use is an isotropic graphite material as described previously.

A carburizing method according to a second aspect of the present invention is a method for subjecting a tantalum container made of tantalum or a tantalum alloy, having a bottom part and a sidewall part extending substantially vertically from the bottom part, and also having an opening defined by an end of the sidewall part to a carburization process for allowing carbon to penetrate the container from the surface toward the inner portion thereof and includes the steps of: setting the tantalum container in a chamber containing a carbon source to face the opening of the tantalum container downward; and subjecting the tantalum container to a carburization process by reducing in pressure and heating the interior of the chamber to allow carbon derived from the carbon source to penetrate the tantalum container from the surface thereof.

In the second aspect of the present invention, the tantalum container is set in the chamber to face the opening of the tantalum container downward and then subjected to a carburization process. If the tantalum container is set in the chamber to face the opening of the tantalum container upward and then subjected to a carburization process, a problem may arise in that with the progress of carburization the opening of the tantalum container may be gradually enlarged, so that a tantalum- or tantalum alloy-made lid put on the tantalum container may not be able to close the tantalum container. If the fit between the tantalum container and the lid is bad, the hermeticity in the tantalum container cannot be maintained. Therefore, in reacting a silicon carbide (SiC) single crystal with silicon (Si) gas, a problem may arise in that silicon gas may leak from the container, so that the silicon carbide single crystal cannot be treated or grown in good conditions.

In the second aspect of the present invention, it can be prevented that in carburizing a tantalum container with an opening, the opening is largely enlarged by carburization. In addition, the distortion of the opening can be reduced. Therefore, the fit between the tantalum container and the lid put on the tantalum container can be kept in good condition, resulting in increased hermeticity in the container.

In the second aspect of the present invention, the tantalum container is preferably set in the chamber so that a clearance is formed below the end of the sidewall part of the tantalum container. The formation of a clearance below the end of the sidewall part of the tantalum container enables carbon derived from the carbon source to be sufficiently supplied also to the inside surface of the tantalum container. Therefore, the carburization process in the inside surface of the tantalum container can be performed similarly to that in the outside surface of the tantalum container, so that the entire surface of the tantalum container can be uniformly carburized.

The clearance below the end of the sidewall part of the tantalum container is preferably not less than 1 mm and more preferably within the range of 2 mm to 20 mm, although it depends on the size and shape of the tantalum container. If the clearance is too small, a sufficient amount of carbon may not be able to be supplied to the inside surface of the tantalum container, so that the carburization process in the inside surface of the tantalum container may be insufficient. Furthermore, if the clearance is too large compared to the above upper limit, an effect due to increase in the clearance beyond the upper limit cannot be obtained.

In the second aspect of the present invention, an example of a method for supporting the tantalum container in the chamber is a method in which the bottom part of the tantalum container is supported from the inside thereof. More specifically, the bottom part of the tantalum container can be supported from the inside on a support member provided in the chamber.

In the second aspect of the present invention, although the carbon source exists in the chamber, the chamber itself may serve as the carbon source. An example of a usable material for the carbon source is graphite. Therefore, with the use of a chamber in which at least the surface is formed from graphite, the chamber can serve as a carbon source. Because the chamber will be thermally treated at high temperatures, the preferred graphite for use is an isotropic graphite material. More preferred is a high-purity graphite material subjected to high purity treatment using a halogen-containing gas or the like. The ash content in the graphite material is preferably 20 ppm or less, more preferably 5 ppm or less. Its bulk density is preferably 1.6 or more, more preferably 1.8 or more. The upper limit of the bulk density is 2.1, for example. An example of a method for producing an isotropic graphite material is as follows. Petroleum coke or coal coke serving as a filler is ground to particles of a few micrometers to tens of micrometers in diameter, a binder, such as pitch, coal tar, or coal tar pitch, is added to the filler, followed by kneading of them. The resultant kneaded product is ground to particles of a few micrometers to tens of micrometers in diameter to have a greater ground particle size than the filler as a base material, thereby obtaining a ground product. It is preferred that particles of over 100 lam in diameter should be removed. The ground product is formed, fired, and graphitized to produce a graphite material. Thereafter, the graphite material is subjected to high purity treatment using halogen-containing gas or the like to give an ash content of 20 ppm or less in the graphite material, so that the mixture of impurity elements from the graphite material into the tantalum container can be prevented.

In the second aspect of the present invention, the support member provided to be located inside the tantalum container and supporting the bottom part of the tantalum container from the inside may serve as the carbon source. When the support member provided inside the tantalum container serves as the carbon source, a sufficient amount of carbon can be supplied to the inside surface of the tantalum container, so that the inside surface of the tantalum container can be uniformly carburized like the outside surface of the tantalum container.

An example of the support member serving as a carbon source is a support member formed from the graphite material as described above.

A tantalum container according to the present invention is characterized by being carburized by the method according to the second aspect of the present invention.

In the method according to the second aspect of the present invention, the opening of the tantalum container can be prevented from being enlarged by carburization and the distortion of the opening can be reduced. Therefore, the tantalum container according to the present invention can be a tantalum container having a good fit with a lid and high hermeticity.

Advantageous Effects of Invention

In the first aspect of the present invention, a tantalum member is less deformed by carburization and can be carburized with good flatness of the planar part and in a uniform manner.

In the second aspect of the present invention, in carburizing a tantalum container with an opening, the opening can be prevented from being enlarged by the carburization and the distortion of the opening can be reduced. Therefore, the hermeticity of the tantalum container when fitted with a lid can be increased.

DESCRIPTION OF EMBODIMENTS

<First Aspect of the Invention>

Hereinafter, the first aspect of the present invention will be described with reference to specific embodiments; however, the first aspect of the present invention is not limited by the following embodiments.

Figure 1:
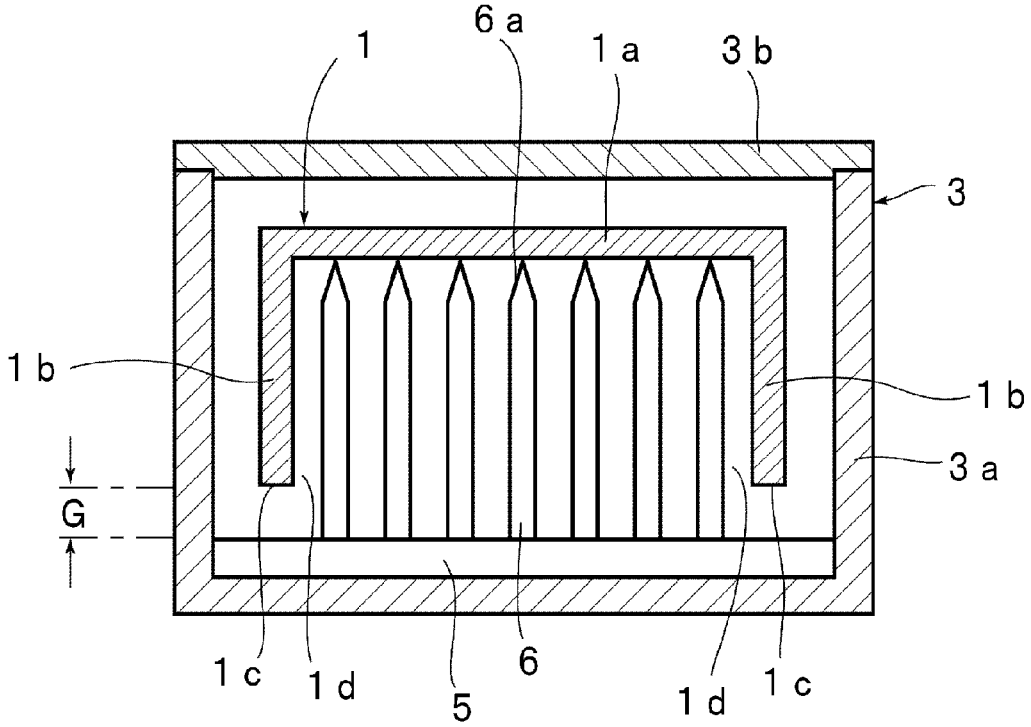
FIG. 1 is a cross-sectional view for illustrating a carburizing method of an embodiment according to the first aspect of the present invention.

FIG. 1 is a cross-sectional view for illustrating a carburizing method of an embodiment according to the first aspect of the present invention.

A tantalum container 1 is set in a chamber 3 formed of a chamber container 3*a* and a chamber lid 3*b*.

Figure 3:
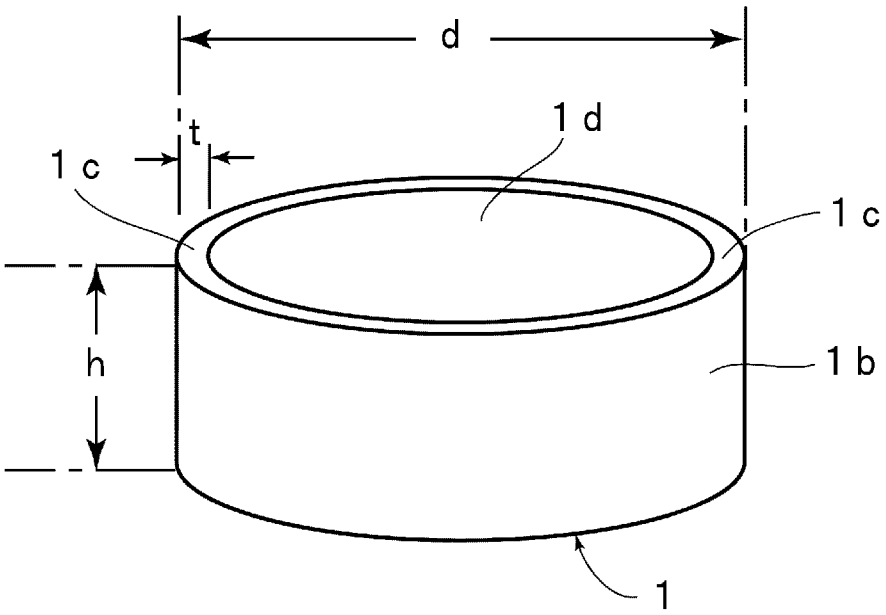
FIG. 3 is a perspective view showing a tantalum container for use in the embodiment shown in FIG. 1.
Figure 4:
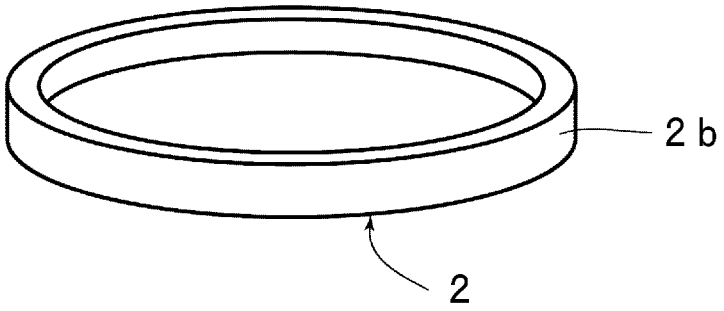
FIG. 4 is a perspective view showing a tantalum lid for use with the tantalum container shown in FIG. 3.

FIG. 3 is a perspective view showing the tantalum container 1. FIG. 4 is a perspective view showing a tantalum lid 2 made of tantalum or a tantalum alloy for use in hermetically closing the tantalum container 1 shown in FIG. 3.

Figure 5:
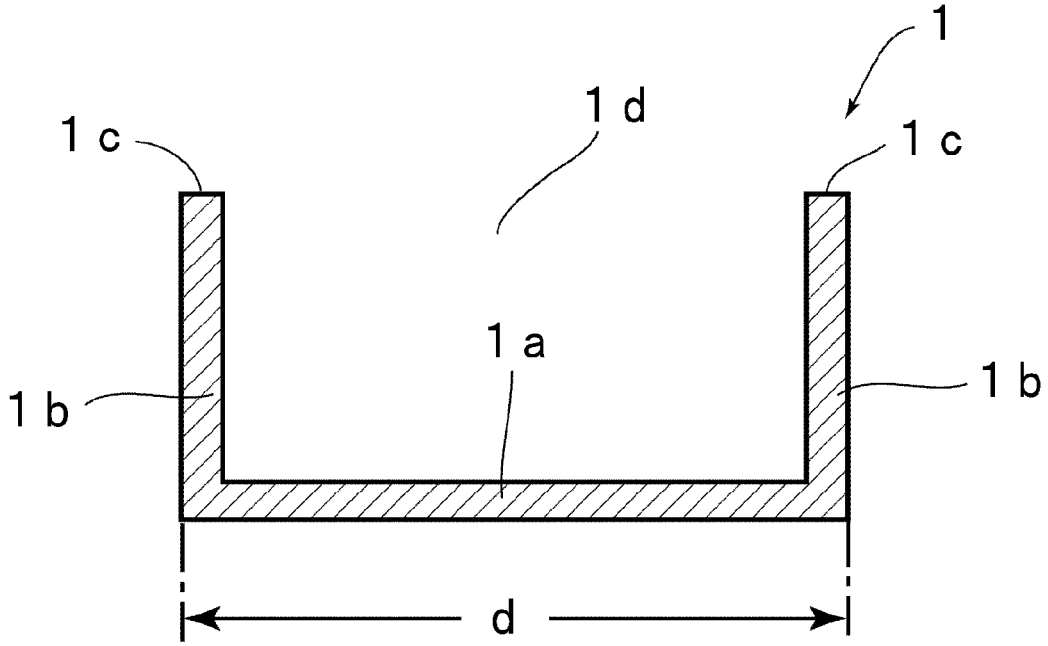
FIG. 5 is a cross-sectional view of the tantalum container shown in FIG. 3.

FIG. 5 is a cross-sectional view showing the tantalum container 1. As shown in FIG. 5, the tantalum container 1 includes a planar part 1*a* and a sidewall part 1*b* extending from the peripheral edge of the planar part 1*a* substantially vertically to the planar part 1*a*. An opening 1*d* of the tantalum container 1 is defined by an end 1*c* of the sidewall part 1*b*. As used herein, the term "substantially vertically" includes directions within 90°±20°.

Figure 6:
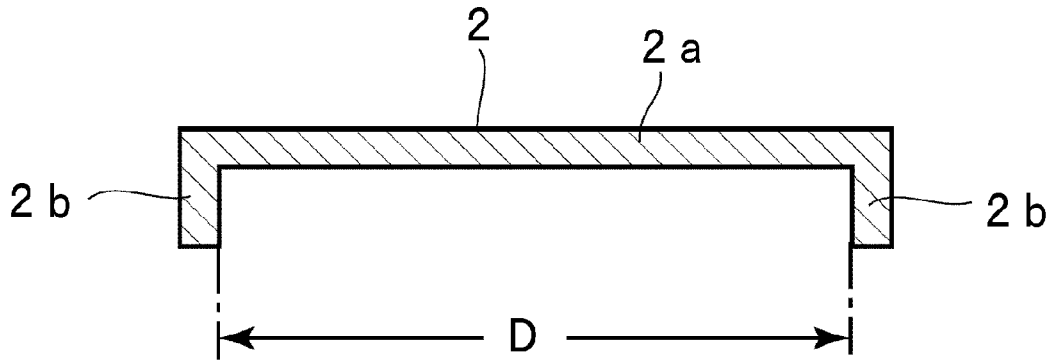
FIG. 6 is a cross-sectional view of the tantalum lid shown in FIG. 4.

FIG. 6 is a cross-sectional view showing the tantalum lid 2 for hermetically closing the opening 1*d* of the tantalum container 1 shown in FIG. 5. As shown in FIG. 6, the tantalum lid 2 includes a planar part 2*a* and a sidewall part 2*b* extending substantially vertically from the planar part 2*a*.

Figure 7:
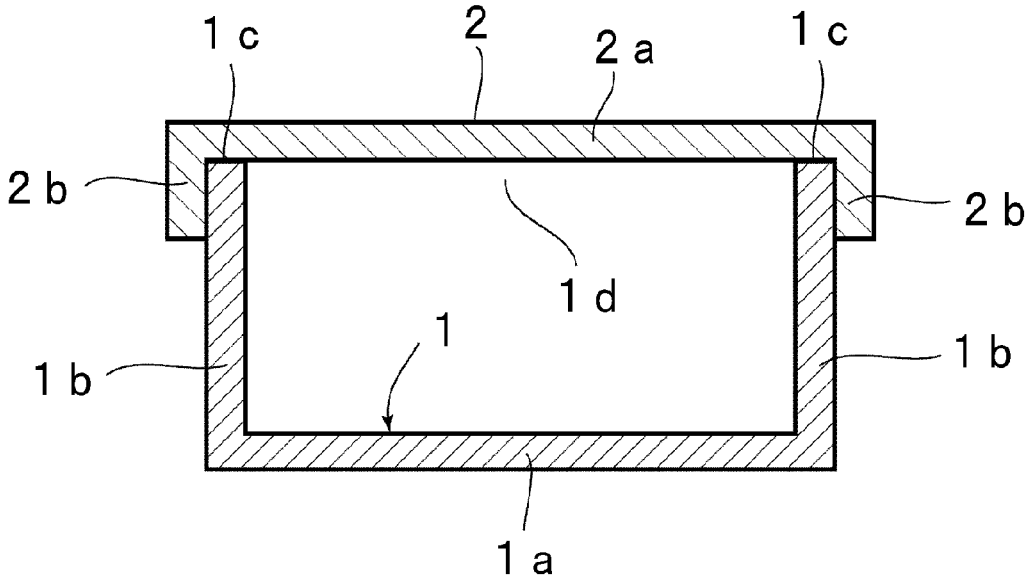
FIG. 7 is a cross-sectional view showing a state that the tantalum lid shown in FIG. 6 is fitted to the tantalum container shown in FIG. 5.

FIG. 7 is a cross-sectional view showing a state that the tantalum lid 2 shown in FIG. 6 is put on the end 1*c* of the sidewall part 1*b* of the tantalum container 1 shown in FIG. 5 to hermetically close the tantalum container 1. As shown in FIG. 7, the sidewall part 1*b* of the tantalum container 1 is placed on the inside of the sidewall part 2*a* of the tantalum lid 2, so that the tantalum lid 2 is put on the tantalum container 1 to hermetically close the tantalum container 1.

As shown in FIG. 7, since the sidewall part 1*b* of the tantalum container 1 is located on the inside of the sidewall part 2*a* of the tantalum lid 2, the inside diameter D of the sidewall part 2*b* of the tantalum lid 2 shown in FIG. 6 is designed to be slightly greater than the outside diameter d of the tantalum container 1 shown in FIG. 5. Normally, the inside diameter D of the tantalum lid 2 is designed to be about 0.1 mm to about 4 mm greater than the outside diameter d of the tantalum container 1.

The tantalum container 1 and the tantalum lid 2 are formed from tantalum or a tantalum alloy. The tantalum alloy is an alloy containing tantalum as a major component, and examples thereof include alloys in which tungsten or niobium is contained in tantalum metal.

The tantalum container 1 and the tantalum lid 2 are produced, for example, by machining, drawing from a sheet, or sheet-metal processing. Machining is a processing method in which a single tantalum metal blank is machined in the form of a container. Although it can yield high-precision shapes, it produces large amounts of metal cut away, resulting in increased material cost. Drawing is a processing method in which a single tantalum metal sheet is deformed into the shape of a container in one step. A sheet of metal is placed between a die and a punch for producing a container and the punch is then pushed in toward the die, so that the sheet material is deformed into a container shape in such a manner as to be pressed into the die. A blank holder is previously set in order that while the metal sheet is pressed in, a portion of the metal sheet located outside the die will not be wrinkled. As compared to machining, drawing can finish in a shorter period of time and produces less filings, resulting in reduced cost. Sheet-metal processing is a processing method in which a single metal sheet is formed into the shape of a container by cutting, bending, and welding it. In this case, the cost for material can be reduced as compared to machining, but the production time is longer than that of drawing.

Each of the tantalum container 1 and tantalum lid 2 is carburized to allow carbon to penetrate it from its surface toward its inner portion, so that the carbon can be diffused into the inner portion. The penetration of carbon causes the formation of a $Ta_2C$ layer, a TaC layer, or the like. A tantalum carbide layer with a high carbon content is first formed on the surface of the container. Since carbon is then diffused into the inner portion of the container, the container surface is turned into a tantalum carbide layer with a high tantalum content, which permits storage of a carbon flux. Therefore, by carrying out liquid phase growth or vapor phase growth of silicon carbide in a crucible formed of a carburized tantalum container and a carburized tantalum lid, carbon vapor generated during the growth process can be stored in the crucible wall, so that a low impurity concentration silicon atmosphere can be formed in the crucible, the occurrence of defects in the surface of a resultant single crystal silicon carbide layer can be reduced, and the surface can be planarized. Furthermore, by thermally annealing the surface of a single crystal silicon carbide substrate in such a crucible, the occurrence of defects can be reduced and the surface can be planarized.

Referring back to FIG. 1, the carburization process in this embodiment is described.

As shown in FIG. 1, the above-described tantalum container 1 is set in the chamber 3 formed of a chamber container 3*a* and a chamber lid 3*b*. The tantalum container 1 is set in the chamber 3 to face the end 1*c* of the sidewall part 1*b* downward. The tantalum container 1 is supported in the chamber 3 by supporting the planar part 1*a* of the tantalum container 1 from the inside on a plurality of support rods 6.

As shown in FIG. 1, the distal ends 6*a* of the support rods 6 are tapered so that their diameter diminishes toward the extremity. By tapering the distal ends 6*a*, the contact area between the distal ends 6*a* of the support rods 6 and the planar part 1*a* of the tantalum container 1 can be made small. In this embodiment, the contact area between the distal end 6*a* of each support rod 6 and the planar part 1*a* is 0.28 $mm^2$. The contact area of the distal end 6*a* is preferably within the range of 0.03 to 12 $mm^2$, more preferably within the range of 0.1 to 8 $mm^2$, and still more preferably within the range of 0.2 to 5 $mm^2$. If the contact area of the distal end 6*a* is too small, the distal end will be likely to be chipped and will be difficult to process. On the other hand, if the contact area of the distal end 6*a* is too large and if the support rod 6 is formed from graphite material, the planar part 1*a* and the distal ends 6*a* may stick to each other during a carburization process, which will make it difficult to remove the tantalum container 1 from the support rods 6 after the carburization process.

Figure 2:
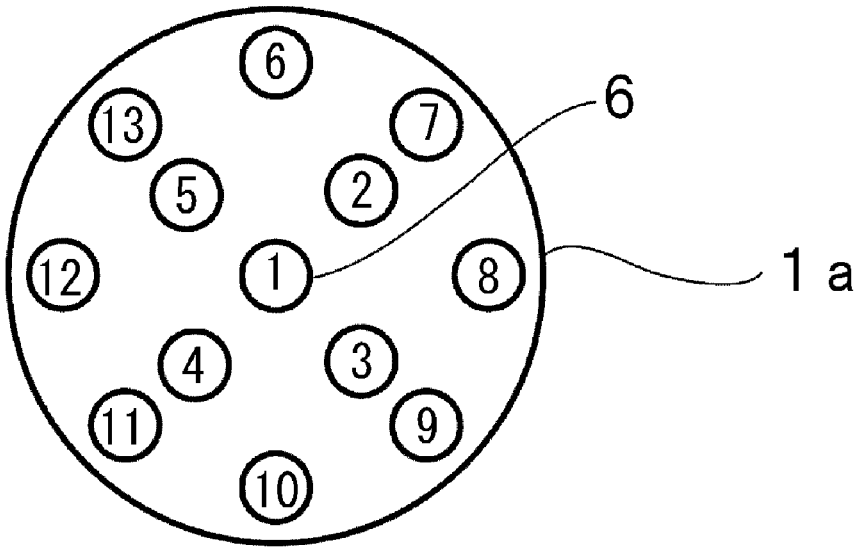
FIG. 2 is a plan view showing the positions of support rods in the embodiment shown in FIG. 1.

FIG. 2 is a plan view showing an arrangement state of the support rods 6 with respect to the planar part 1*a*. As shown in FIG. 2, in this embodiment, thirteen support rods 6 support the planar part 1*a* of the tantalum container 1 from the inside.

As shown in FIG. 2, the thirteen support rods 6 are distributed so that the distal ends of the support rods 6 substantially evenly support the planar part 1*a*.

The support rods 6 are supported by a support base 5, as shown in FIG. 1. In this embodiment, the support base 5 is formed with holes and the lower ends of the support rods 6 are inserted in the holes, whereby the support rods 6 are supported by the support base 5.

In this embodiment, the chamber 3, i.e., the chamber container 3*a* and chamber lid 3*b*, the support rods 6, and the support base 5 are formed from graphite. Therefore, in this embodiment, the chamber 3, the support rods 6, and the support base 5 are carbon sources. The chamber 3, the support rods 6, and the support base 5 can be produced by machining.

The size and shape of the chamber 3 are preferably selected so that the clearance between the outside surface of the container 1 and the chamber 3 is substantially even as a whole. Thus, the distance of the container from the chamber serving as a carbon source can be substantially equal as a whole, so that the container can be entirely uniformly carburized.

In addition, a clearance G is preferably formed below the end 1*c* of the sidewall part 1*b* of the tantalum container 1. The formation of the clearance G enables carbon to be supplied also to the inside surface of the tantalum container 1 from outside the tantalum container 1. The clearance G is preferably within the range of 2 mm to 20 mm as described previously.

As described above, the support rods 6 and support base 5 which are disposed inside the tantalum container 1 also serve as carbon sources. Therefore, as shown in FIG. 2, the arrangement of the support rods 6 is preferably such an arrangement that they are substantially evenly distributed inside the tantalum container 1.

After in the above manner the tantalum container 1 is set in the chamber 3, the chamber 3 is reduced in pressure and then heated, so that the tantalum container 1 can be carburized.

For example, the chamber 3 can be reduced in pressure by placing the chamber 3 in a vacuum vessel, closing the vacuum vessel, and evacuating the vacuum vessel. The pressure in the chamber 3 is reduced, for example, to 10 Pa or below.

Next, the interior of the chamber 3 is heated to a predetermined temperature. The heating temperature is preferably within the range of 1700° C. or above, more preferably within the range of 1750° C. to 2500° C., and still more preferably within the range of 2000° C. to 2200° C. When heated to such a temperature, the interior of the chamber 3 generally reaches a pressure of about $10^{-2}$ Pa to about 10 Pa.

The time for which the predetermined temperature is held is preferably within the range of 0.1 to 8 hours, more preferably within the range of 0.5 to 5 hours, and still more preferably within the range of 1 to 3 hours. Because the rate of carburization varies depending on the temperature to be held, the holding time is adjusted depending on a desired thickness of carburization.

Although no particular limitation is placed on the rate of temperature rise and the cooling rate, the rate of temperature rise is generally preferably within the range of 100° C./hour to 2000° C./hour, more preferably within the range of 300° C./hour to 1500° C./hour, and still more preferably within the range of 500° C./hour to 1000° C./hour. The cooling rate is preferably within the range of 40° C./hour to 170° C./hour, more preferably within the range of 60° C./hour to 150° C./hour, and still more preferably within the range of 80° C./hour to 130 hours/hour. The cooling is generally implemented by natural cooling.

As described above, in this embodiment, the planar part 1*a* of the tantalum container 1 is supported on the plurality of support rods 6 tapered at the distal ends 6*a*, and in this state a carburization process is performed. Since the planar part 1*a* of the tantalum container 1 is supported on the plurality of support rods 6, the tantalum container 1 is less deformed by carburization and can be carburized with good flatness of the planar part 1*a*. In addition, since the distal ends 6*a* of the support rods 6 are tapered, the entire surface of the tantalum container 1 can be uniformly carburized.

Moreover, in this embodiment, since the chamber 3, the support rods 6, and the support base 5 are formed from a graphite material to serve as carbon sources, the entire surface of the tantalum container 1 can be more uniformly carburized.

Furthermore, in this embodiment, the tantalum container 1 is set in the chamber 3 to face the opening 1*d* of the tantalum container 1 downward and in this state subjected to a carburization process. Therefore, it can be prevented that the opening 1*d* of the tantalum container 1 is enlarged. Therefore, as shown in FIG. 7, in putting the tantalum lid 2 on the tantalum container 1, the lid 2 can be put in a good condition, so that the hermeticity in the tantalum container 1 can be kept well. Hence, when thermal annealing or crystal growth is performed in the tantalum container 1, silicon vapor can be held in a good condition in the tantalum container 1, so that a good crystal state can be obtained.

The tantalum member which can be carburized by the carburizing method according to the first aspect of the present invention is not limited to such a tantalum container 1; for example, the tantalum lid 2 can also be carburized.

Figure 12:
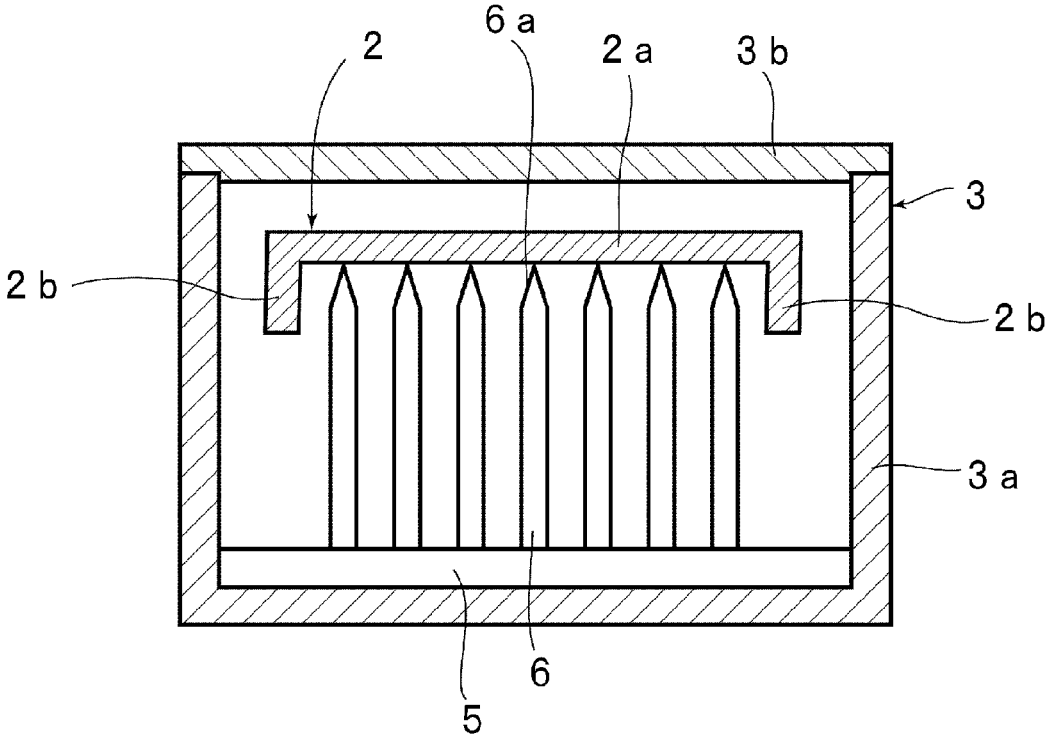
FIG. 12 is a cross-sectional view showing a method for carburizing a tantalum lid in still another embodiment according to the first aspect of the present invention.

FIG. 12 is a cross-sectional view showing a state that the tantalum lid 2 is carburized. Like the embodiment shown in FIG. 1, the planar part 2*a* of the tantalum lid 2 is supported on thirteen support rods 6 tapered at the distal ends 6*a*, and in this state the interior of the chamber 3 is heated, so that the surface of the tantalum lid 2 can be carburized.

Also in the carburization of the tantalum lid 2, the tantalum lid 2 is less deformed by the carburization and can be carburized with good flatness of the planar part 2*a*, and the entire surface of the tantalum lid 2 can be uniformly carburized.

EXAMPLES

Hereinafter, the first aspect of the present invention will be described in more detail with reference to specific examples; however, the first aspect of the present invention is not limited by the following examples.

Example 1

A tantalum container 1 was carburized using a chamber 3 shown in FIG. 1. The tantalum container 1 used was one shown in FIG. 3 and having an outside diameter d of 158 mm, a height h of 60 mm, and a thickness t of 3 mm. Therefore, the inside diameter of the planar part 1*a* on the inside of the tantalum container 1 is 152 mm and the area thereof is 18136 $mm^2$.

In this example, as shown in FIG. 2, thirteen support rods 6 were arranged with respect to the planar part 1*a*. Therefore, the planar part 1*a* was supported by the support rods 6, one per 1395 $mm^2$ of the area of the planar part 1.

The chamber 3 used was a chamber 3 whose interior is a columnar space measuring 210 mm in diameter and 90 mm high. The material used for the chamber container 3*a* and the chamber lid 3*b* was an isotropic graphite material with a bulk density of 1.8.

The support rods 6 used were those measuring 6 mm in diameter and 75 mm long. The length of the tapered portion of the distal end 6*a* was 15 mm. The contact area of the distal end 6*a* was 0.28 $mm^2$. The support rods 6 and the support base 5 were formed from the same isotropic graphite material as the chamber container 3*a*.

The clearance G below the end 1*c* of the sidewall part 1*b* of the tantalum container 1 was 13 mm.

Figure 13:
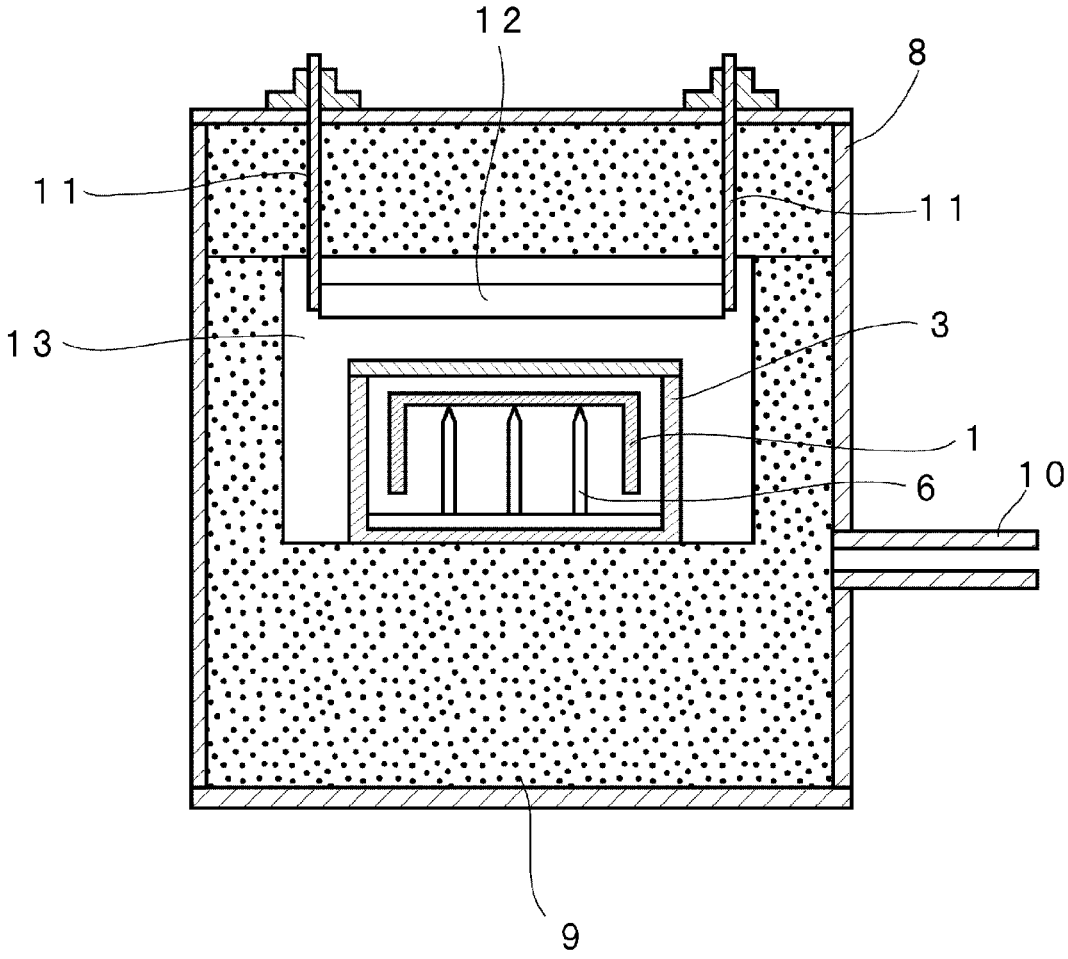
FIG. 13 is a cross-sectional view for illustrating a carburization process in an example according to the first aspect of the present invention.

The tantalum container 1 was set in the chamber 3 in the above manner, and the chamber 3 was then placed in a vacuum vessel 8 measuring 800 mm in diameter×800 mm high and made of SUS stainless steel. FIG. 13 is a cross-sectional view showing a state that the chamber 3 is placed in the vacuum vessel 8. As shown in FIG. 13, a heat insulating material 9 is provided in the vacuum vessel 8. The chamber 3 was placed in a space 13 formed in the heat insulating material 9. The heat insulating material 9 used was a material having a trade name "DON-1000" (with a bulk density of 0.16 g/cm$^3$, manufactured by Osaka Gas Chemicals Co., Ltd.). This heat insulating material is a material obtained by impregnating pitch-based carbon fibers with resin, molding, curing, carbonizing, and graphitizing the fibers and is therefore a porous heat insulating material.

A carbon heater 12 is disposed in an upper part of the space 13 surrounded by the heat insulating material 9, and the carbon heater 12 is supported by graphite electrodes 11 for passing electric current through the carbon heater 12. By passage of electric current through the carbon heater 12, the space 13 enclosed by the heat insulating material 9 can be heated.

The vacuum vessel 8 has an exhaust outlet 10 formed to evacuate the vacuum vessel 8 therethrough. The exhaust outlet 10 is connected to an unshown vacuum pump.

The vacuum vessel 8 was evacuated to reduce the pressure in the chamber 3 to 0.1 Pa or below, and the interior of the chamber 3 was then heated to 2150° C. at a rate of temperature rise of 710°/hour by the carbon heater 12. A carburization process was performed by holding 2150° C. for two hours. The interior of the chamber 3 was at a pressure of about 0.5 to about 2.0 Pa.

After the carburization process, the chamber interior was cooled to room temperature by natural cooling. The cooling time was approximately 15 hours.

The planar part 1*a* of the tantalum container 1 before and after the carburization process was determined in terms of out-of-roundness and out-of-flatness in the following manner.

Using a 3D coordinate measuring machine, measurement data at eight equally spaced points around the circumference of the planar part 1*a* were obtained for the out-of-roundness, and measurement data at the above eight circumferential points and a point located at the center of the planar part 1*a* were obtained for the out-of-flatness. The out-of-roundness and out-of-flatness were obtained by deviations from their respective finally determined average element-shape lines. Specifically, for the out-of-roundness, a circular surface shape was recognized from an average line obtained from measurement data at the points, and the maximum value of respective deviations from the average line at the points was considered as the out-of-roundness. For the out-of-flatness, an average line was recognized from measurement data at the points, and the maximum value of respective deviations from the average line at the points was considered as the out-of-flatness. The determination results are shown in Table 1.

Example 2

Figure 8:
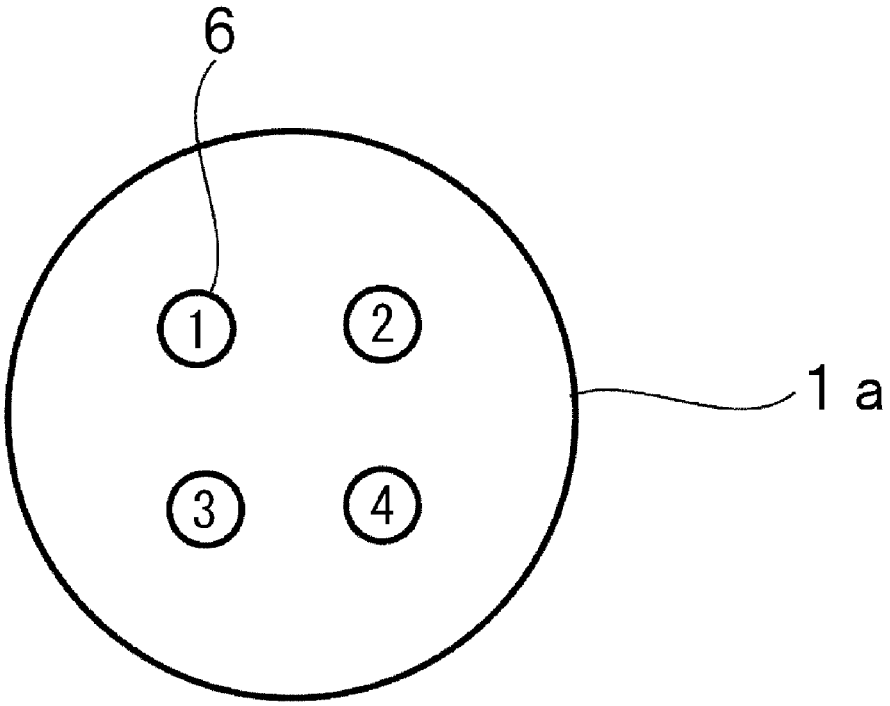
FIG. 8 is a plan view showing the positions of support rods in another embodiment according to the first aspect of the present invention.

A tantalum container 1 was carburized in the same manner as in Example 1 except that four support rods 6 were distributed with respect to the planar part 1*a* of the tantalum container 1 as shown in FIG. 8.

The planar part 1*a* of the tantalum container 1 before and after the carburization process was determined in terms of out-of-roundness and out-of-flatness in the same manner as described above, and the determination results are shown in Table 1.

Example 3

Figure 9:
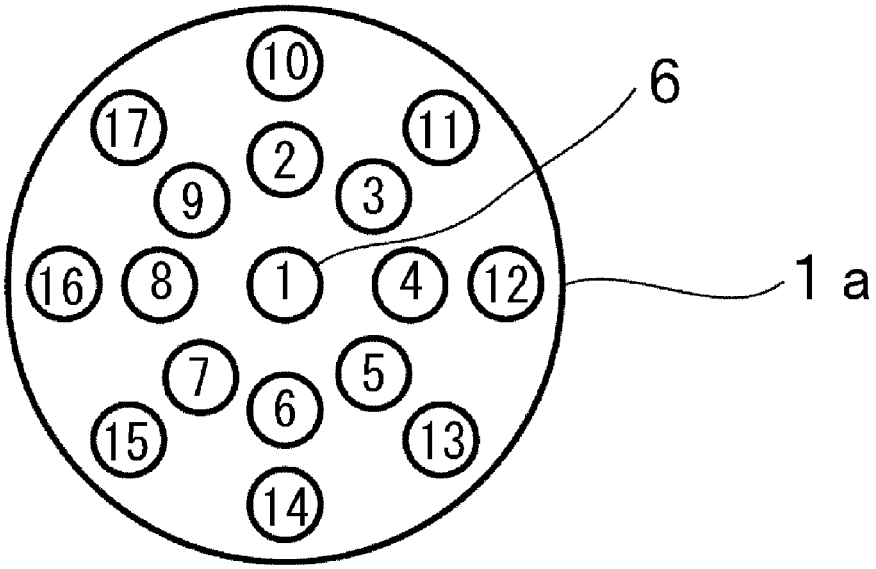
FIG. 9 is a plan view showing the positions of support rods in still another embodiment according to the first aspect of the present invention.

A tantalum container 1 was carburized in the same manner as in Example 1 except that seventeen support rods 6 were distributed with respect to the planar part 1*a* of the tantalum container 1 as shown in FIG. 9.

The planar part 1*a* of the tantalum container 1 before and after the carburization process was determined in terms of out-of-roundness and out-of-flatness in the same manner as described above, and the determination results are shown in Table 1.

Comparative Example 1

Figure 10:
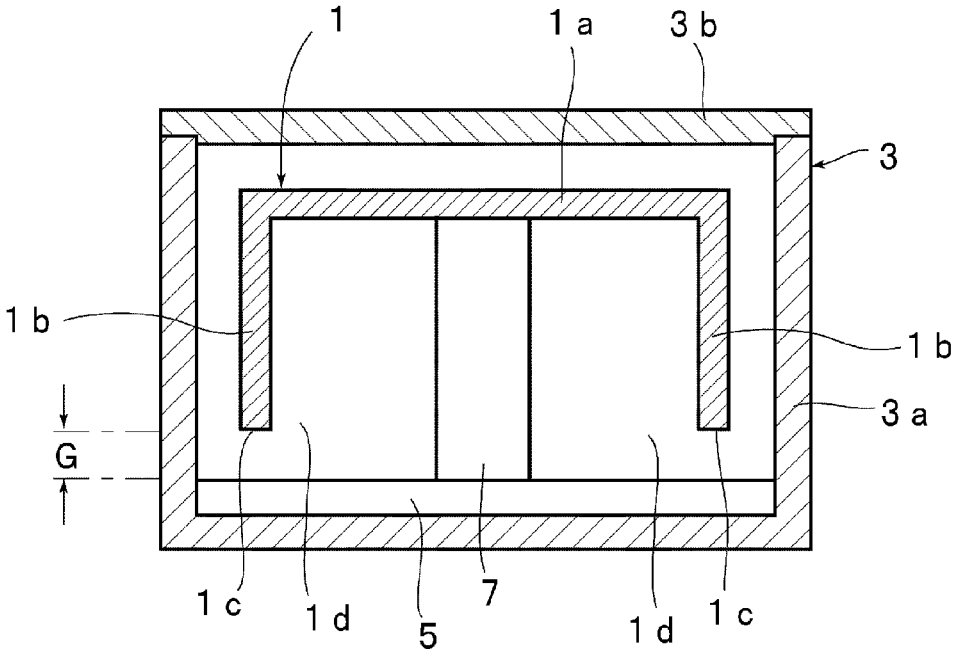
FIG. 10 is a cross-sectional view for illustrating a carburizing method in a comparative example.
Figure 11:
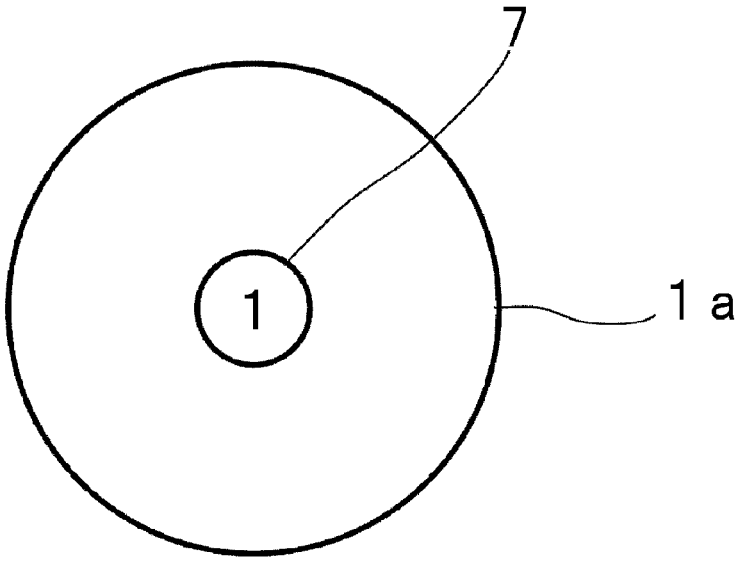
FIG. 11 is a plan view showing the position of a support rod in the comparative example shown in FIG. 10.

As shown in FIG. 10, a columnar support rod 12 mm in diameter and 75 mm long was used as a support rod 7 for supporting a planar part 1*a* of a tantalum container 1. FIG. 11 is a plan view showing a placement state of the support rod 7 with respect to the planar part 1*a*. As shown in FIG. 11, the single columnar support rod 7 was placed at the center of the planar part 1*a* so that the planar part 1*a* was supported on the support rod 7. The support rod 7 was also formed from an isotropic graphite material, like the support rods 6. A carburization process was performed for the rest in the same manner as in Example 1.

The distal end of the support rod stuck to the planar part 1*a* of the tantalum container 1 owing to the carburization process and was difficult to detach from it after the carburization process. Therefore, the out-of-roundness and out-of-flatness of the planar part 1*a* could not be determined. However, the tantalum container 1 was more largely deformed than Example 2 in which the tantalum container was supported on four support rods, and it was clearly seen from this that the tantalum container 1 was inferior in roundness and flatness to Example 2.

TABLE 1

| | Out-of-Roundness | | Out-of-Flatness | | Planar Part Area/ |
|---|---|---|---|---|---|
| | Before Carburization | After Carburization | Before Carburization | After Carburization | Number of Support Rods (mm$^2$) |
| Ex. 1 | 0.467 | 0.575 | 0.540 | 0.696 | 1395 |
| Ex. 2 | 0.228 | 0.662 | 0.739 | 1.109 | 4534 |
| Ex. 3 | 0.593 | 0.715 | 0.359 | 0.470 | 1067 |

As is evident from the results of the above Examples 1 to 3 and Comparative Example 1, by carburizing a tantalum container with its planar part supported on a plurality of support rods tapered at the distal ends in accordance with the first aspect of the present invention, the tantalum container is less deformed by carburization and can be carburized with good flatness of the planar part.

In addition, as is evident from the results shown in Table 1, it can be seen that Example 1 in which the planar part was supported on thirteen support rods and Example 3 in which the planar part was supported on seventeen support rods are superior in roundness and flatness to Example 2 in which the planar part was supported on four support rods. Therefore, by supporting the planar part on support rods, one or more per 1500 mm$^2$ of the area of the planar part, the deformation due to carburization can be further reduced and the carburization process can be performed with better flatness of the planar part.

<Second Aspect of the Invention>

Hereinafter, the second aspect of the present invention will be described with reference to a specific embodiment; however, the second aspect of the present invention is not limited by the following embodiment.

Figure 14:
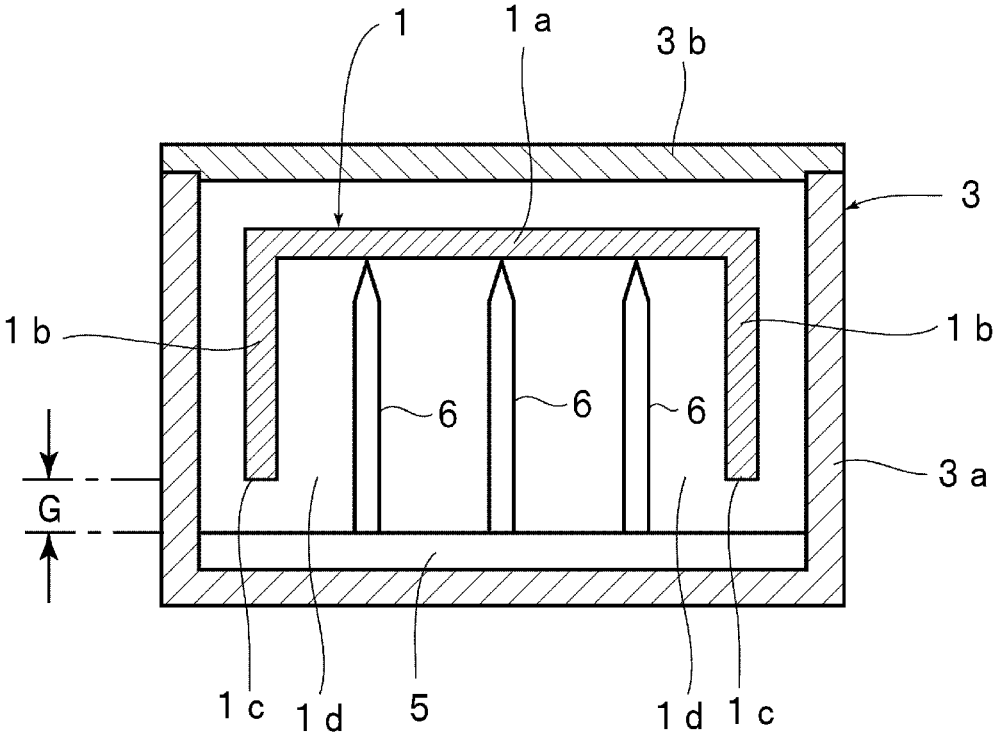
FIG. 14 is a cross-sectional view for illustrating a carburizing method of an embodiment according to the second aspect of the present invention.

FIG. 14 is a cross-sectional view for illustrating a carburizing method of an embodiment according to the second aspect of the present invention.

A tantalum container 1 is set in a chamber 3 formed of a chamber container 3*a* and a chamber lid 3*b*.

Figure 16:
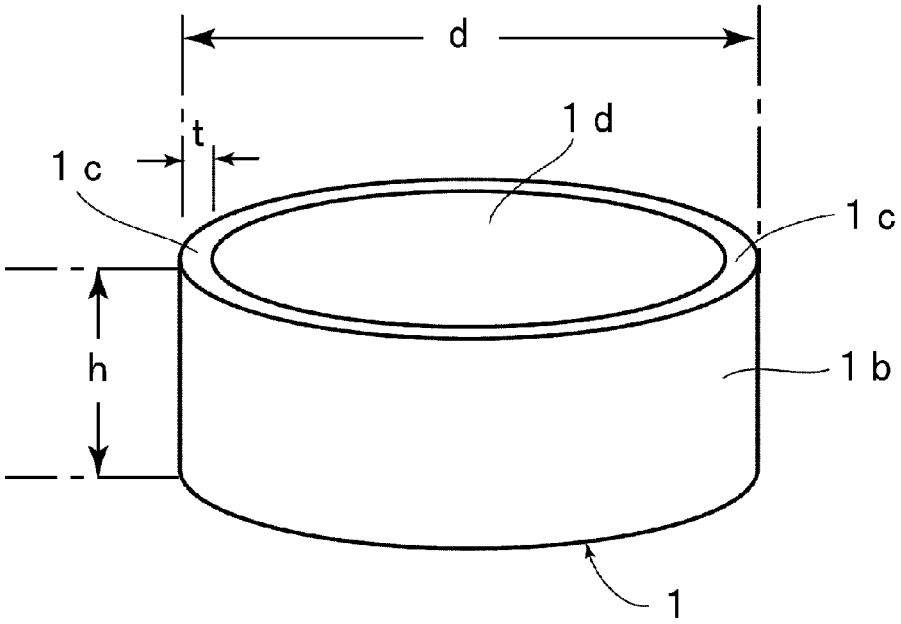
FIG. 16 is a perspective view showing a tantalum container for use in the embodiment shown in FIG. 14.
Figure 17:
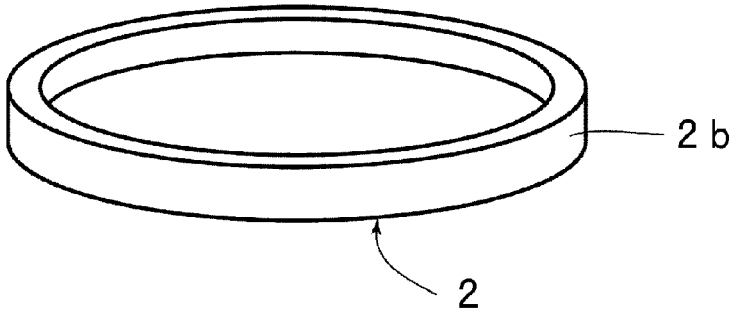
FIG. 17 is a perspective view showing a lid for use with the tantalum container shown in FIG. 16.

FIG. 16 is a perspective view showing the tantalum container 1. FIG. 17 is a perspective view showing a lid 2 made of tantalum or a tantalum alloy for use in hermetically closing the tantalum container 1 shown in FIG. 16.

Figure 18:
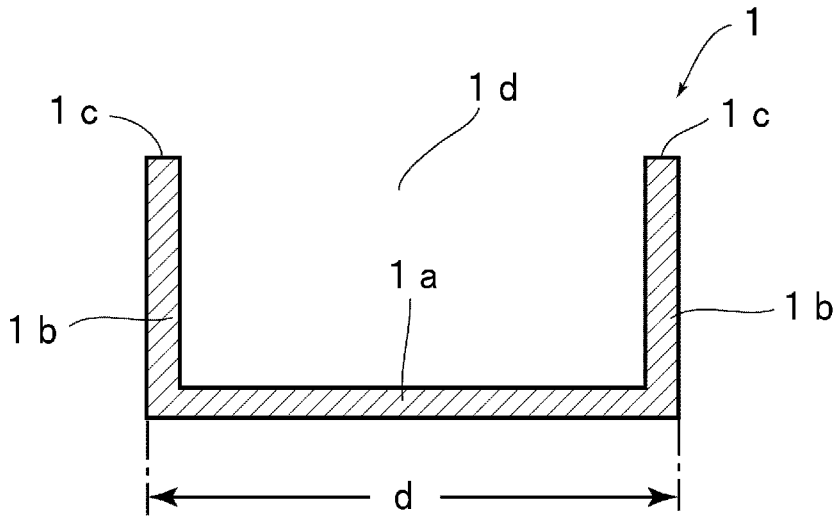
FIG. 18 is a cross-sectional view of the tantalum container shown in FIG. 16.

FIG. 18 is a cross-sectional view showing the tantalum container 1. As shown in FIG. 18, the tantalum container 1 includes a bottom part 1*a* and a sidewall part 1*b* extending from the peripheral edge of the bottom part 1*a* substantially vertically to the bottom part 1*a*. An opening 1*d* of the tantalum container 1 is defined by an end 1*c* of the sidewall part 1*b*. As used herein, the term "substantially vertically" includes directions within 90°±20°.

Figure 19:
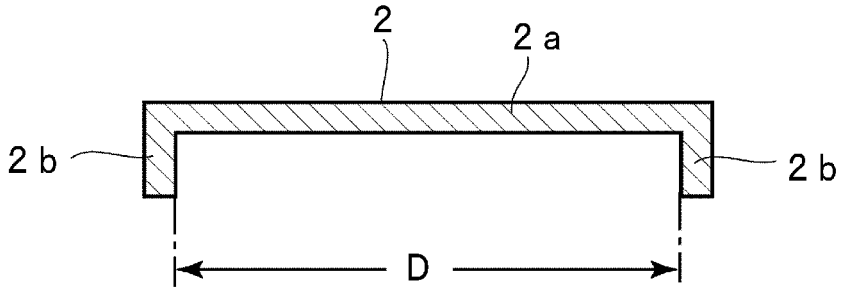
FIG. 19 is a cross-sectional view of the lid shown in FIG. 17.

FIG. 19 is a cross-sectional view showing the lid 2 for hermetically closing the opening 1*d* of the tantalum container 1 shown in FIG. 18. As shown in FIG. 19, the lid 2 includes a top part 2*a* and a sidewall part 2*b* extending substantially vertically from the top part 2*a*.

Figure 20:
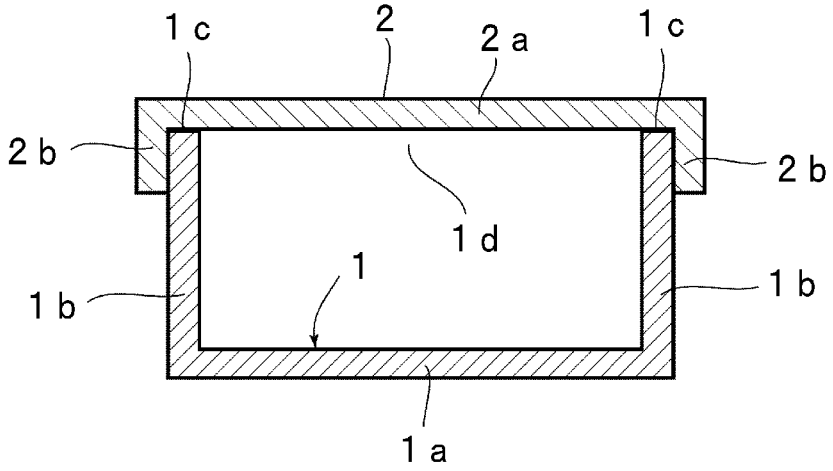
FIG. 20 is a cross-sectional view showing a state that the lid shown in FIG. 19 is fitted to the tantalum container shown in FIG. 18.

FIG. 20 is a cross-sectional view showing a state that the lid 2 shown in FIG. 19 is put on the end 1*c* of the sidewall part 1*b* of the tantalum container 1 shown in FIG. 18 to hermetically close the tantalum container 1. As shown in FIG. 20, the sidewall part 1*b* of the tantalum container 1 is placed on the inside of the sidewall part 2*a* of the lid 2, so that the lid 2 is put on the tantalum container 1 to hermetically close the tantalum container 1.

As shown in FIG. 20, since the sidewall part 1*b* of the tantalum container 1 is located on the inside of the sidewall part 2*a* of the lid 2, the inside diameter D of the sidewall part 2*b* of the lid 2 shown in FIG. 19 is designed to be slightly greater than the outside diameter d of the tantalum container 1 shown in FIG. 18. Normally, the inside diameter D of the lid 2 is designed to be about 0.1 mm to about 4 mm greater than the outside diameter d of the tantalum container 1.

The tantalum container 1 and the lid 2 are formed from tantalum or a tantalum alloy. The tantalum alloy is an alloy containing tantalum as a major component, and examples thereof include alloys in which tungsten or niobium is contained in tantalum metal.

The tantalum container 1 and the lid 2 are produced, for example, by machining, drawing from a sheet, or sheet-metal processing. Machining is a processing method in which a single tantalum metal blank is machined in the form of a container. Although it can yield high-precision shapes, it produces large amounts of metal cut away, resulting in increased material cost. Drawing is a processing method in which a single tantalum metal sheet is deformed into the shape of a container in one step. A sheet of metal is placed between a die and a punch for producing a container and the punch is then pushed in toward the die, so that the sheet material is deformed into a container shape in such a manner as to be pressed into the die. A blank holder is previously set in order that while the metal sheet is pressed in, a portion of the metal sheet located outside the die will not be wrinkled. As compared to machining, drawing can finish in a shorter period of time and produces less filings, resulting in reduced cost. Sheet-metal processing is a processing method in which a single metal sheet is formed into the shape of a container by cutting, bending, and welding it. In this case, the cost for material can be reduced as compared to machining, but the production time is longer than that of drawing.

Each of the tantalum container 1 and lid 2 is carburized to allow carbon to penetrate it from its surface toward its inner portion, so that the carbon can be diffused into the inner portion. The penetration of carbon causes the formation of a $Ta_2C$ layer, a TaC layer, or the like.

A tantalum carbide layer with a high carbon content is first formed on the surface of the container. Since carbon is then diffused into the inner portion of the container, the container surface is turned into a tantalum carbide layer with a high tantalum content, which permits storage of a carbon flux.

Therefore, by carrying out liquid phase growth or vapor phase growth of silicon carbide in a crucible formed of a carburized tantalum container and a carburized lid, carbon vapor generated during the growth process can be stored in the crucible wall, so that a low impurity concentration silicon atmosphere can be formed in the crucible, the occurrence of defects in the surface of a resultant single crystal silicon carbide layer can be reduced, and the surface can be planarized. Furthermore, by thermally annealing the surface of a single crystal silicon carbide substrate in such a crucible, the occurrence of defects can be reduced and the surface can be planarized.

Referring back to FIG. 14, the carburization process in this embodiment is described.

As shown in FIG. 14, the above-described tantalum container 1 is set in the chamber 3 formed of a chamber container 3*a* and a chamber lid 3*b*. The tantalum container 1 is set in the chamber 3 to face the end 1*c* of the sidewall part 1*b* downward. The tantalum container 1 is supported in the chamber 3 by supporting the bottom part 1*a* of the tantalum container 1 from the inside on a plurality of support rods 6.

Figure 15:
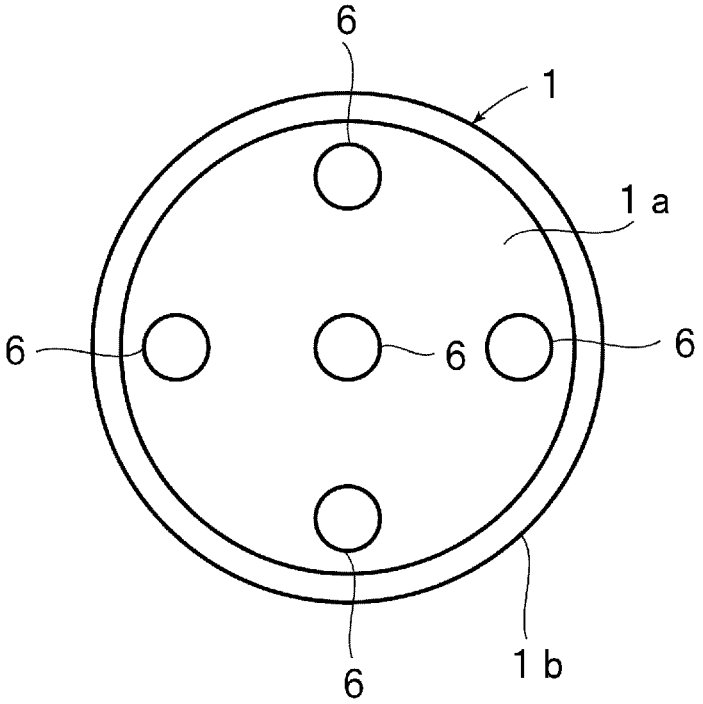
FIG. 15 is a plan view showing the positions of support rods in the embodiment shown in FIG. 14.

FIG. 15 is a plan view showing an arrangement state of the support rods 6. As shown in FIG. 15, in this embodiment, five support rods 6 support the bottom part 1*a* of the tantalum container 1 from the inside.

As shown in FIG. 14, the distal ends of the support rods 6 are tapered so that they diminish toward the extremities. By tapering, the contact area between the support rods 6 and the bottom part 1*a* of the tantalum container 1 can be made small to reduce the problem with carburization due to the contact of the support rods.

The support rods 6 are supported by a support base 5, as shown in FIG. 14. In this embodiment, the support base 5 is formed with holes and the lower ends of the support rods 6 are inserted in the holes, whereby the support rods 6 are supported by the support base 5.

In this embodiment, the chamber 3, i.e., the chamber container 3*a* and chamber lid 3*b*, the support rods 6, and the support base 5 are formed from graphite. Therefore, in this embodiment, the chamber 3, the support rods 6, and the support base 5 are carbon sources. The chamber 3, the support rods 6, and the support base 5 can be produced by machining.

The size and shape of the chamber 3 are preferably selected so that the clearance between the outside surface of the container 1 and the chamber 3 is substantially even as a whole. Thus, the distance of the container from the chamber serving as a carbon source can be substantially equal as a whole, so that the container can be entirely uniformly carburized.

In addition, a clearance G is preferably formed below the end 1*c* of the sidewall part 1*b* of the tantalum container 1. The formation of the clearance G enables carbon to be supplied also to the inside surface of the tantalum container 1 from outside the tantalum container 1. The clearance G is preferably within the range of 2 mm to 20 mm as described previously.

As described above, the support rods 6 and support base 5 which are disposed inside the tantalum container 1 also serve as carbon sources. Therefore, as shown in FIG. 15, the arrangement of the support rods 6 is preferably such an arrangement that they are substantially evenly distributed inside the tantalum container 1.

After in the above manner the tantalum container 1 is set in the chamber 3, the chamber 3 is reduced in pressure and then heated, so that the tantalum container 1 can be carburized.

The chamber 3 can be reduced in pressure by placing the chamber 3 in a vacuum vessel and evacuating the vacuum vessel. The pressure in the chamber 3 is reduced, for example, to 10 Pa or below.

Next, the interior of the chamber 3 is heated to a predetermined temperature. The heating temperature is preferably within the range of 1700° C. or above, more preferably within the range of 1750° C. to 2500° C., and still more preferably within the range of 2000° C. to 2200° C. When heated to such a temperature, the interior of the chamber 3 generally reaches a pressure of about $10^{-2}$ Pa to about 10 Pa.

The time for which the predetermined temperature is held is preferably within the range of 0.1 to 8 hours, more preferably within the range of 0.5 to 5 hours, and still more preferably within the range of 1 to 3 hours. Because the rate of carburization varies depending on the temperature to be held, the holding time is adjusted depending on a desired thickness of carburization.

Although no particular limitation is placed on the rate of temperature rise and the cooling rate, the rate of temperature rise is generally preferably within the range of 100° C./hour to 2000° C./hour, more preferably within the range of 300° C./hour to 1500° C./hour, and still more preferably within the range of 500° C./hour to 1000° C./hour. The cooling rate is preferably within the range of 40° C./hour to 170° C./hour, more preferably within the range of 60° C./hour to 150° C./hour, and still more preferably within the range of 80° C./hour to 130 hours/hour. The cooling is generally implemented by natural cooling.

When the tantalum container 1 is set in the chamber 3 to face the opening 1*d* of the tantalum container 1 downward as shown in FIG. 14 and in this state subjected to a carburization process, the enlargement and distortion of the opening 1*d* can be reduced. Therefore, as shown in FIG. 20, in putting the lid 2 on the tantalum container 1, the lid 2 can be put in a good fit condition, so that the hermeticity of the tantalum container 1 can be kept well. Hence, when thermal annealing or crystal growth is performed in the tantalum container 1, silicon vapor can be held in a good condition in the tantalum container 1, so that a good crystal state can be obtained.

EXAMPLES

Hereinafter, the second aspect of the present invention will be described in more detail with reference to a specific example; however, the second aspect of the present invention is not limited by the following example.

Example 4

A tantalum container 1 was carburized using a chamber 3 shown in FIG. 14. The tantalum container 1 used was one shown in FIG. 16 and having an outside diameter d of approximately 160 mm, a height h of approximately 60 mm, and a thickness t of approximately 3 mm. The tantalum container 1 was produced by sheet-metal processing metal tantalum.

The chamber 3 used was a chamber 3 whose interior is of a columnar shape measuring 210 mm in diameter and 90 mm high. The material used for the chamber container 3*a* and the chamber lid 3*b* was an isotropic graphite material with a bulk density of 1.8.

The support rods 6 used were those measuring 6 mm in diameter and 75 mm long. The length of the tapered portion of the distal end was 15 mm. The support rods 6 and the support base 5 were formed from the same isotropic graphite material as the chamber container 3*a*.

The clearance G below the end 1*c* of the sidewall part 1*b* of the tantalum container 1 was 13 mm.

Figure 25:
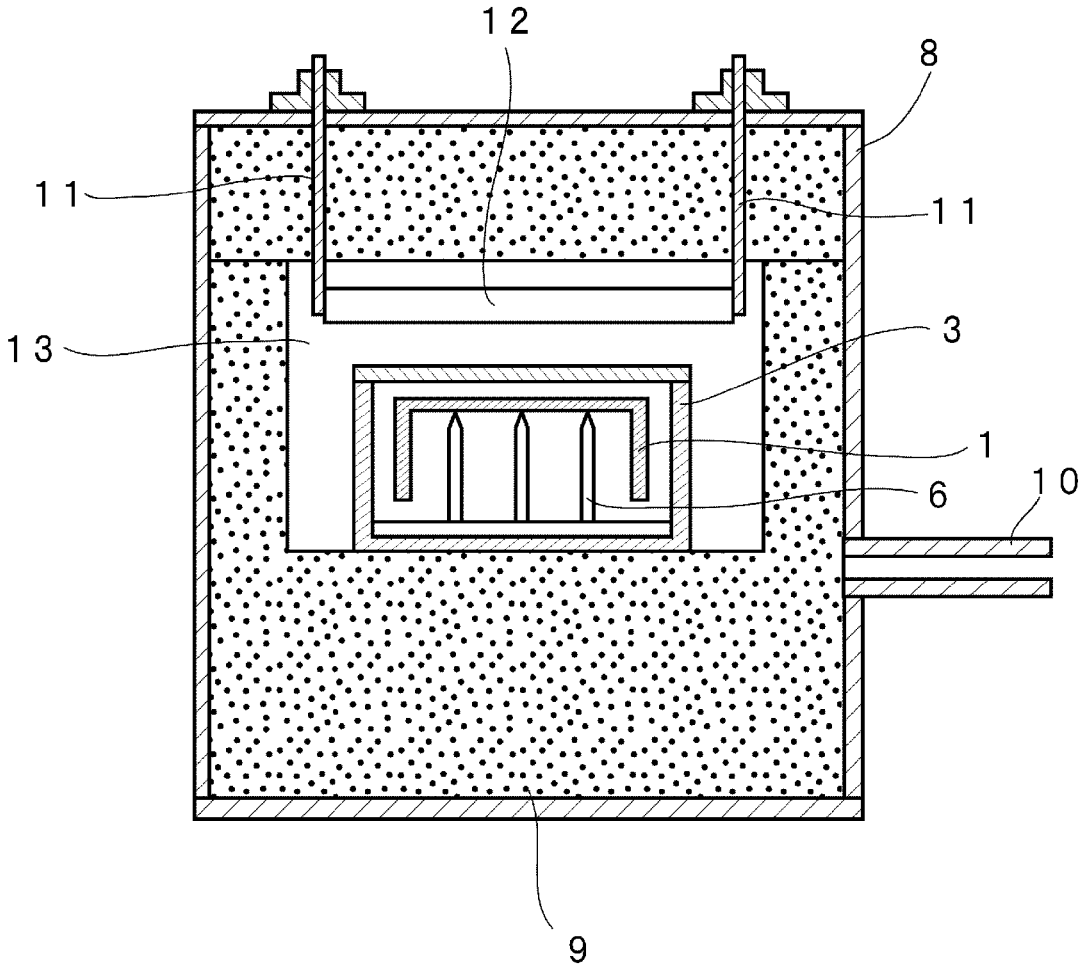
FIG. 25 is a cross-sectional view for illustrating a carburization process in the example according to the second aspect of the present invention.

The tantalum container 1 was set in the chamber 3 in the above manner, and the chamber 3 was then placed in a vacuum vessel 8 measuring 800 mm in diameter×800 mm high and made of SUS stainless steel. FIG. 25 is a cross-sectional view showing a state that the chamber 3 is placed in the vacuum vessel 8. As shown in FIG. 25, a heat insulating material 9 is provided in the vacuum vessel 8. The chamber 3 was placed in a space 13 formed in the heat insulating material 9. The heat insulating material 9 used was a material having a trade name "DON-1000" (with a bulk density of 0.16 g/cm$^3$, manufactured by Osaka Gas Chemicals Co., Ltd.). This heat insulating material is a material obtained by impregnating pitch-based carbon fibers with resin, molding, curing, carbonizing, and graphitizing the fibers and is therefore a porous heat insulating material.

A carbon heater 12 is disposed in an upper part of the space 13 surrounded by the heat insulating material 9, and the carbon heater 12 is supported by graphite electrodes 11 for passing electric current through the carbon heater 12. By passage of electric current through the carbon heater 12, the space 13 enclosed by the heat insulating material 9 can be heated.

The vacuum vessel 8 has an exhaust outlet 10 formed to evacuate the vacuum vessel 8 therethrough. The exhaust outlet 10 is connected to an unshown vacuum pump.

The vacuum vessel 8 was evacuated to reduce the pressure in the chamber 3 to 0.1 Pa or below, and the interior of the chamber 3 was then heated to 2150° C. at a rate of temperature rise of 710°/hour by the carbon heater 12. A carburization process was performed by holding 2150° C. for two hours. The interior of the chamber 3 was at a pressure of about 0.5 to about 2.0 Pa.

After the carburization process, the chamber interior was cooled to room temperature by natural cooling. The cooling time was approximately 15 hours.

The tantalum container 1 was measured in terms of outside diameter d as a dimension of the opening 1*d* thereof before and after the carburization process. The dimension of the outside diameter d was measured at eight points on the circumference of the opening 1*d*.

Figure 23:
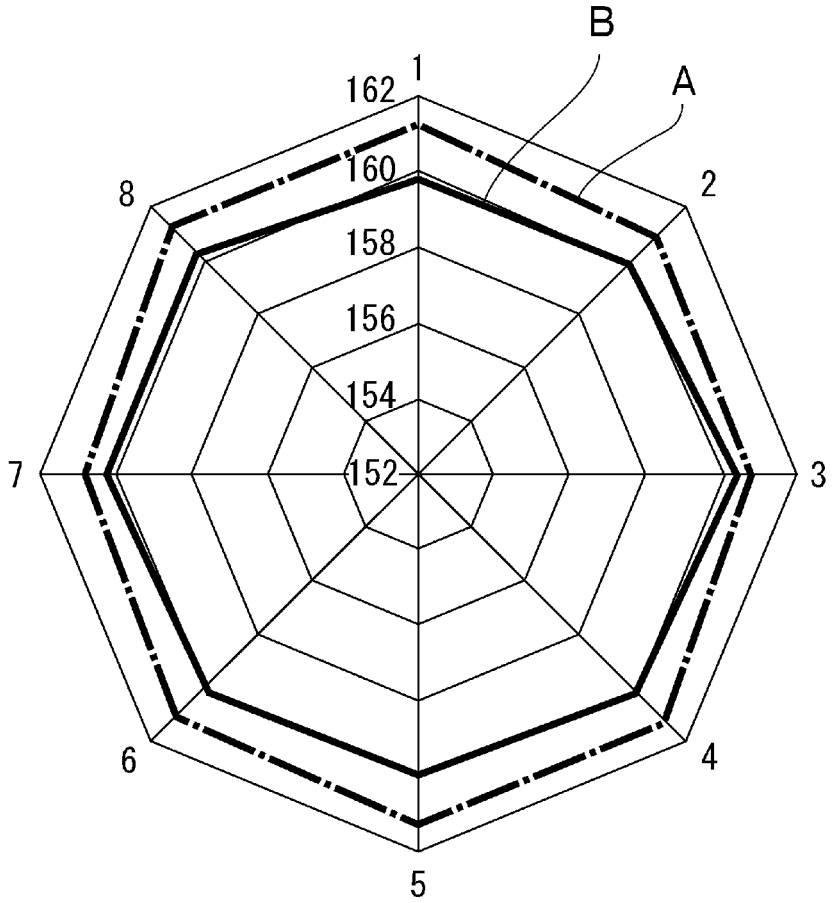
FIG. 23 is a graph showing the positions of an opening of the tantalum container before and after the carburization process in an example according to the second aspect of the present invention.

FIG. 23 is a graph showing dimensions of the outside diameter d at the eight points before and after the carburization process. In FIG. 23, A denotes dimensions before the carburization process and B denotes dimensions after the carburization process.

As shown in FIG. 23, it can be seen that in this example the dimensions of the outside diameter d were slightly reduced by carburization. Furthermore, the out-of-roundness of the opening 1*d* was determined using a 3D coordinate measuring machine. The out-of-roundness was determined from respective measurement data at eight points of the opening 1*d* shown in FIG. 23 and deviations from a finally determined average element-shape line. Specifically, a circular surface shape was recognized from an average line obtained from measurement data at the points, and the maximum value of respective deviations from the average line at the points was considered as the out-of-roundness. The out-of-roundness of the opening 1*d* was 0.467 before the carburization process and 0.575 after the carburization process. Therefore, the difference in out-of-roundness between before and after the carburization process was 0.108.

Comparative Example 2

Figure 21:
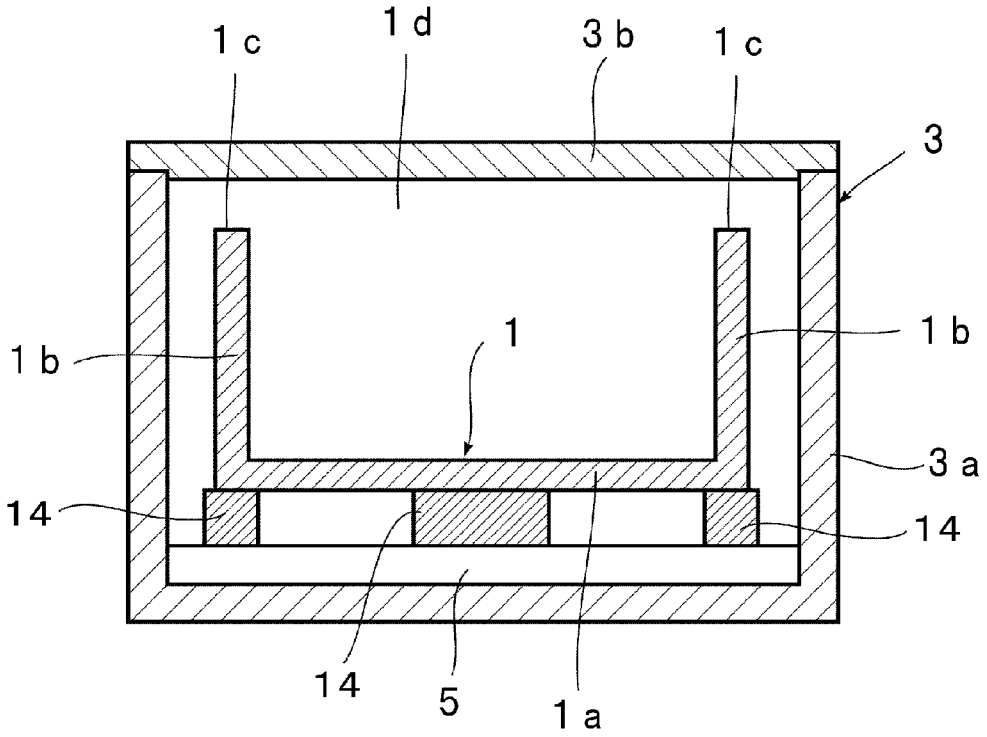
FIG. 21 is a cross-sectional view for illustrating a carburizing method in a comparative example.

FIG. 21 is a cross-sectional view for illustrating a carburization process in this comparative example.

In this comparative example, a chamber container 3*a* and a chamber lid 3*b* which were used are similar to those in Example 4. A tantalum container 1 used is also similar to that in Example 4.

In this comparative example, as shown in FIG. 21, the tantalum container 1 was set in the chamber 3 to face the opening 1*d* of the tantalum container 1 upward.

The tantalum container 1 was put on graphite blocks 14 put on a support base 5.

Figure 22:
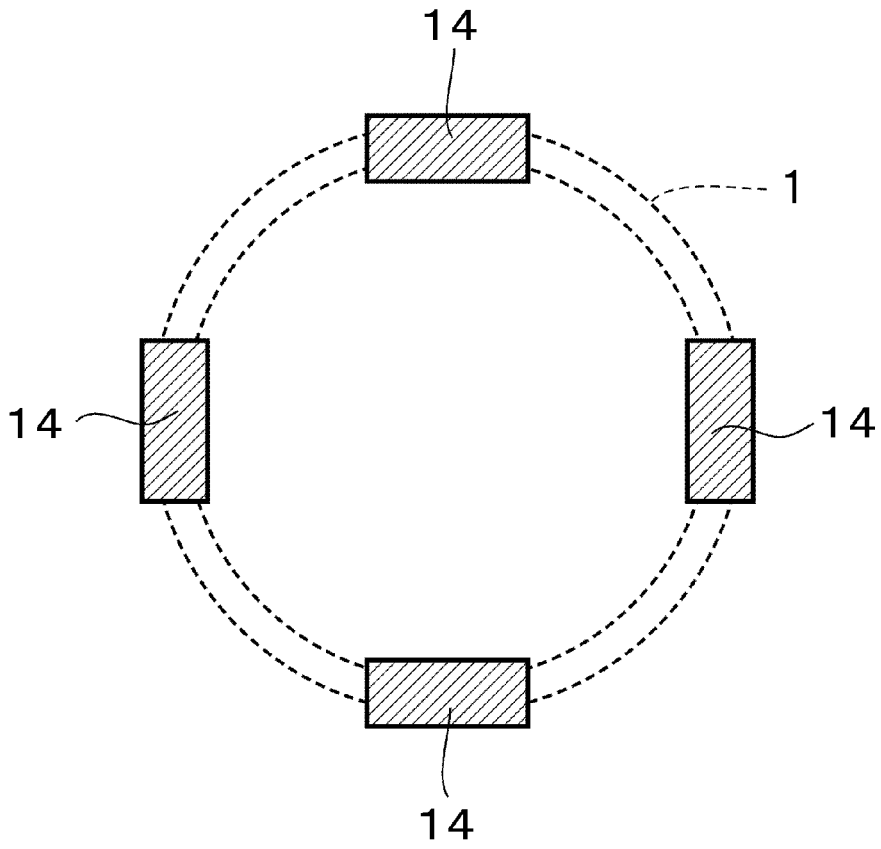
FIG. 22 is a plan view showing the positions of graphite blocks in the comparative example shown in FIG. 21.

FIG. 22 is a plan view showing an arrangement state of the graphite blocks 14 with respect to the tantalum container 1. As shown in FIG. 22, the graphite blocks 14 are provided at four points under the bottom part 1*a* of the tantalum container 1. Each of the graphite blocks 14 used were a graphite block of a rectangular parallelepiped shape measuring 10 mm wide, 30 mm long, and 10 mm high. The graphite blocks 14 used were those formed from the same material as the support rods 6 in Example 4. The support base 5 used is also similar to the support base 5 in Example 4.

The tantalum container 1 was set in the chamber 3 as described above and carburized in the same conditions as in Example 4.

Figure 24:
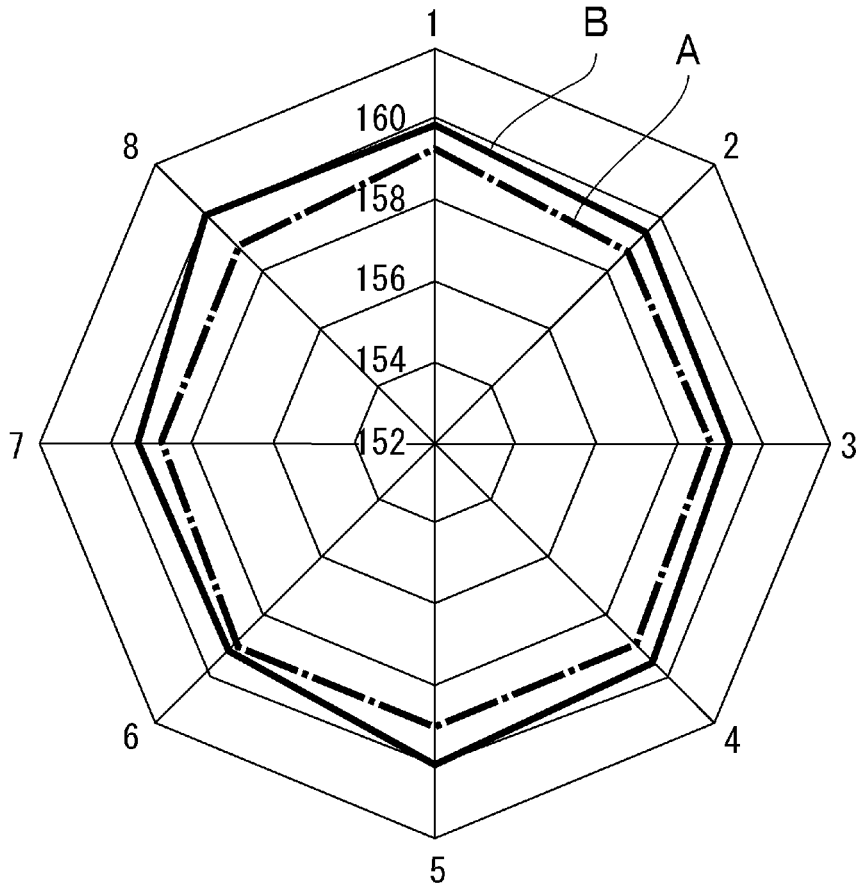
FIG. 24 is a graph showing the positions of an opening of the tantalum container before and after the carburization process in the comparative example.

The outside diameter d of the tantalum container 1 before and after the carburization process was measured in the same manner as described above, and the measurement results are shown in FIG. 24.

In FIG. 24, A denotes dimensions of the outside diameter d before the carburization process and B denotes dimensions of the outside diameter d after the carburization process.

As shown in FIG. 24, it can be seen that in this comparative example the opening 1*d* was enlarged by carburization.

Furthermore, the opening 1*d* was determined in terms of out-of-roundness before and after the carburization process. The out-of-roundness before the carburization process was 0.593 and the out-of-roundness after the carburization process was 0.715. Therefore, the difference in out-of-roundness between before and after the carburization process was 0.122.

As observed above, it can be seen that in Comparative Example 2, the carburization process performed with the opening 1*d* of the tantalum container 1 facing upward caused the opening 1*d* to be enlarged. Therefore, if the lid 2 is put on the tantalum container 1 whose opening 1*d* is enlarged in the above manner, the fit between the tantalum container 1 and the lid 2 will be defective and a gap will be created between them, so that a good hermetically closed state will not be able to be maintained.

In contrast, if as in Example 4 the opening 1*d* is not enlarged, the lid 2 can be put on the tantalum container 1 in a good hermetically closed state. In this example, the opening 1*d* after the carburization process was slightly smaller than before the carburization process. However, in such a case of deformation that the opening 1*d* becomes smaller, the lid 2 can be put on the tantalum container 1 without imparting the hermeticity.

When, as in Comparative Example 2, the opening 1*d* of a tantalum container 1 may be enlarged by carburization, it may be conceivable that taking into account the amount of enlargement of the opening 1*d*, the lid 2 is previously produced to adapt to such an enlarged dimension of the opening 1*d*. However, the amount of enlargement of the opening 1*d* varies depending on the carburization conditions or other conditions and the variation is large. Therefore, even if a lid is produced taking into account a change in dimension of the opening 1*d*, it may not always adapt to the opening 1*d* of the tantalum container 1 and good hermeticity may not be able to be achieved. Then, both the tantalum container 1 and the lid 2 will be defective, which will significantly reduce the work efficiency.

When, as described above, a tantalum container is set to face its opening 1*d* downward and carburized in accordance with the second aspect of the present invention, a tantalum container with a high-roundness opening can be obtained. As seen also from this, by carburizing the tantalum container in accordance with the second aspect of the present invention, the tantalum container fitted with the lid can maintain a good hermetically closed state.

REFERENCE SIGNS LIST

1 . . . Tantalum container
1*a* . . . Planar part or bottom part of tantalum container
1*b* . . . Sidewall part of tantalum container
1*c* . . . End of sidewall part of tantalum container
1*d* . . . Opening of tantalum container
2 . . . Lid
2*a* . . . Planar part or top part of lid
2*b* . . . Sidewall part of lid
3 . . . Chamber
3*a* . . . Chamber container
3*b* . . . Chamber lid
5 . . . Support base
6 . . . Support rod
6*a* . . . Distal end of support rod
7 . . . Support rod
8 . . . Vacuum vessel made of SUS 9 . . . Heat insulating material
10 . . . Exhaust outlet
11 . . . Graphite electrode
12 . . . Carbon heater
13 . . . Space enclosed by heat insulating material
14 . . . Graphite block

The invention claimed is:

1. A method for subjecting a tantalum member made of tantalum or a tantalum alloy and having a planar part to a carburization process for allowing carbon to penetrate the member from the surface toward the inner portion thereof, the method for carburizing the tantalum member comprising the steps of:

setting the tantalum member in a chamber containing a carbon source by supporting the planar part on a plurality of support rods tapered at distal ends thereof and located below the planar part; and subjecting the tantalum member to a carburization process by reducing in pressure and heating the interior of the chamber to allow carbon derived from the carbon source to penetrate the tantalum member from the surface thereof, wherein the distal ends of the plurality of support rods support the entire planar part, and the plurality of support rods serve as the carbon source.

2. The method for carburizing the tantalum member according to claim 1, wherein the planar part is supported by the support rods, and number of the support rods is one or more per 1500 $mm^2$ of the area of the planar part.

3. The method for carburizing the tantalum member according to claim 1, wherein the plurality of support rods are arrayed on a support base in such a manner that the root portions of the support rods are supported to the support base, and the plurality of support rods are arranged in the chamber in such a manner that the support base is put on the bottom of the interior of the chamber.

4. The method for carburizing the tantalum member according to claim 3, wherein the support base serves as the carbon source.

5. The method for carburizing the tantalum member according to claim 1, wherein the chamber serves as the carbon source.

6. The method for carburizing the tantalum member according to claim 1, wherein the tantalum member is a tantalum container having the planar part and a sidewall part extending substantially vertically from the planar part and also having an opening defined by an end of the sidewall part.

7. The method for carburizing the tantalum member according to claim 6, wherein the tantalum container is set in the chamber to face the opening of the tantalum container downward, and the planar part of the tantalum container is supported from the inside on the plurality of support rods.

* * * * *